United States Patent [19]

Miller

[11] 3,985,357

[45] Oct. 12, 1976

[54] LANE-LENGTH-COMPENSATING RACE GAME

[76] Inventor: Robert D. Miller, 17159 Mark Twain, Detroit, Mich. 48235

[22] Filed: July 14, 1975

[21] Appl. No.: 595,539

[52] U.S. Cl. ..... 273/86 G
[51] Int. Cl.[2] ..... A63F 9/14
[58] Field of Search ..... 273/86 G

[56] References Cited

UNITED STATES PATENTS

| | | | |
|---|---|---|---|
| 786,485 | 4/1905 | Von Clanner et al. | 273/86 G |
| 3,650,533 | 3/1972 | Heppes | 273/86 G |

FOREIGN PATENTS OR APPLICATIONS

| | | | |
|---|---|---|---|
| 1,424,428 | 5/1920 | United Kingdom | 273/86 G |

*Primary Examiner*—Anton O. Oechsle
*Attorney, Agent, or Firm*—Willis Bugbee

[57] ABSTRACT

Connected to the contestant game pieces of a J-shaped racecourse game are pull cords guided at a semi-circular turn by laterally-spaced guide members and at the finish line by laterally-spaced upper guide holes in the top wall, whence the pull cords pass through radially-spaced intermediate cord guide holes on a pivoted lane-length-compensating sector gear, and finally through lower cord guide holes in a fixed guide bar to connections on the winding hubs of multiple geared spools loosely and rotatably mounted upon a stationary cross shaft. The geared spools mesh with an elongated half gear on a drive shaft rotated by an external hand crank and carrying a sector gear drive gear meshing with the sector gear teeth. The teeth terminate in a lock notch engageable by a lock pin normally slidable along the top face of the sector gear until it reaches its foremost position, whereupon the lock pin drops into the lock nut to lock the sector gear until the end of the race. The pull cords wind differently at random along the hubs of their respective geared spools, thereby causing chance to determine the winner. Disengaging the half gear from the gear spools enables the contestant pieces to be pulled along their respective lanes back to the starting gate for the next race.

9 Claims, 10 Drawing Figures

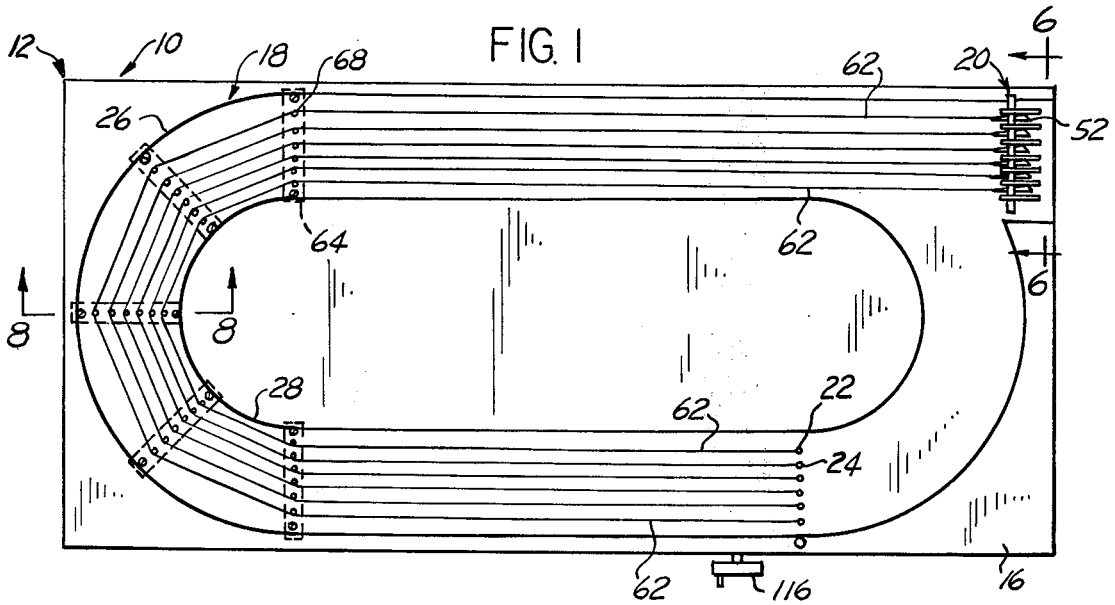
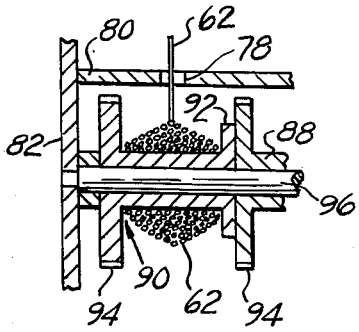
FIG. 10
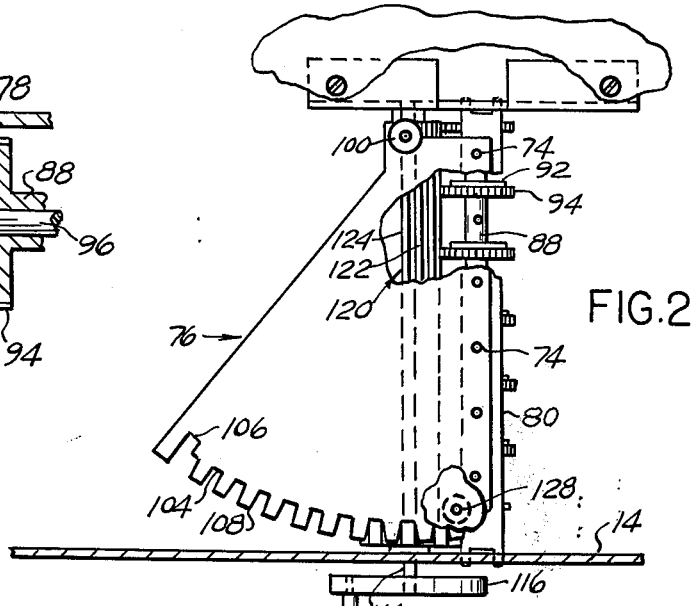
FIG. 2
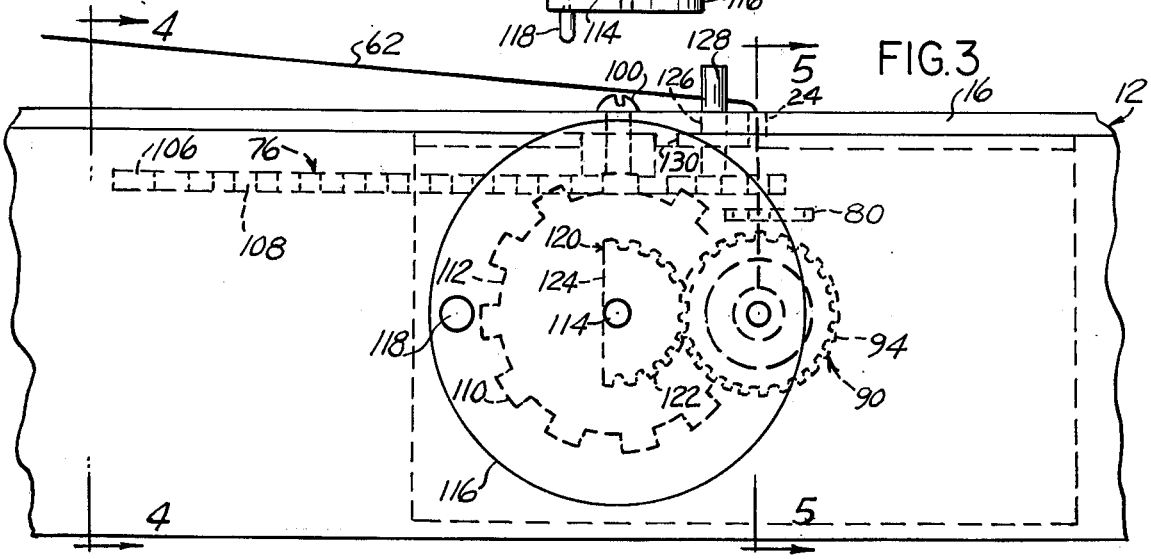
FIG. 3

FIG. 4
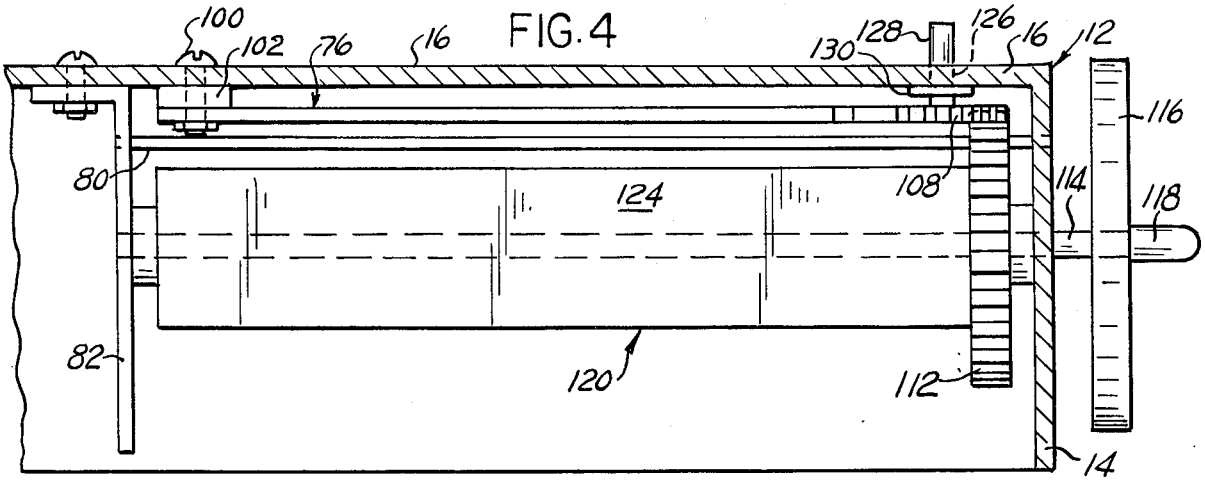
FIG. 5
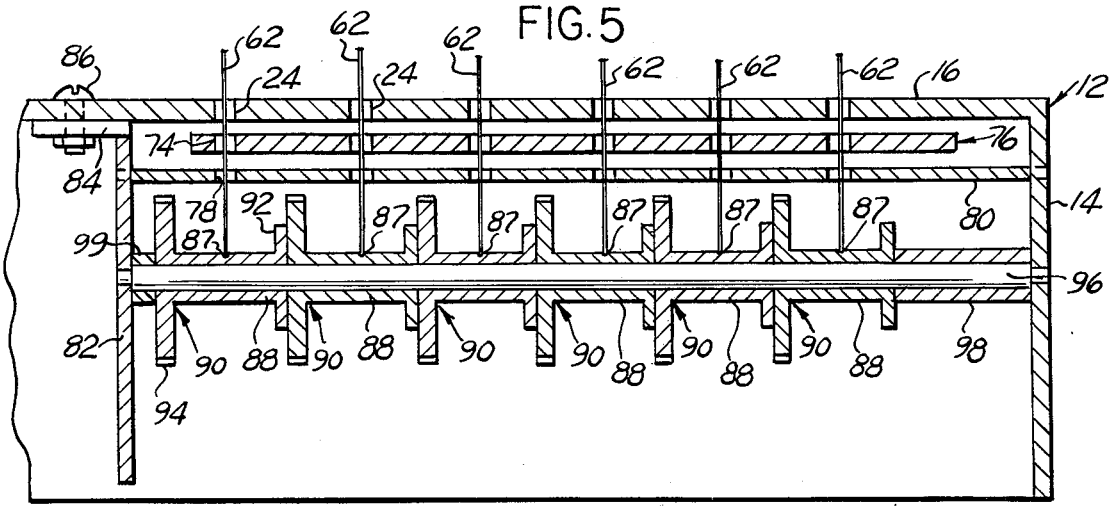
FIG. 6
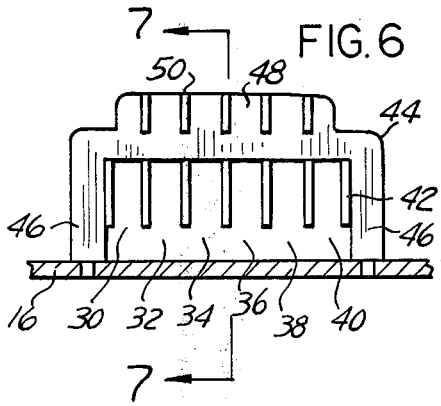
FIG. 7
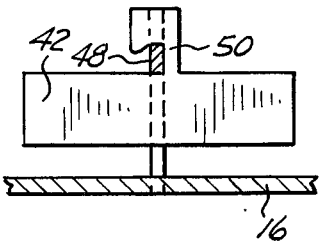
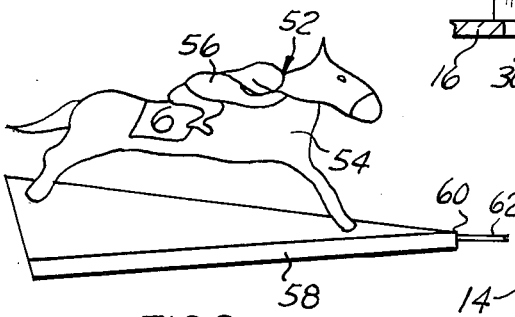
FIG. 9
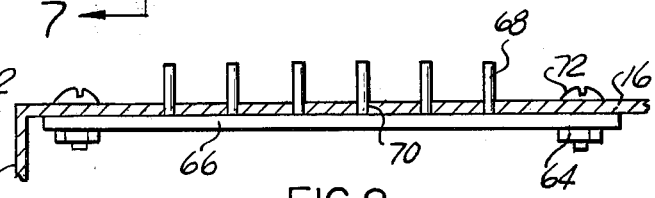
FIG. 8

LANE-LENGTH-COMPENSATING RACE GAME

SUMMARY OF THE INVENTION

Counterclockwise rotation of the sector gear causes its pull cord guide holes to swing faster as their distances from the pivot axis increase, thereby pulling the contestant pieces increasingly faster in the increasingly longer outer lanes than in the shorter inner lanes so as to equalize the length of the lanes. The stop pin locks this compensating sector gear in its foremost position until the race is over. The pull cords wind up haphazardly on their respective gear spools in response to the rotation of their respective gears by the elongated half gear, this random winding pattern introducing a chance element whereby the winning contestant piece cannot be predetermined.

In the drawings,

FIG. 1 is a top plan view of a lane-length-compensating race game, according to one form of the invention, with the contestant pieces disposed in the starting gate and the other moving parts disposed in the positions which they occupy at the start of the race;

FIG. 2 is an enlarged fragmentary top plan view of the driving and lane-length-compensating mechanism of the game of FIG. 1, with the top plate and compensating gear partly broken away to disclose the mechanism therebelow;

FIG. 3 is an enlarged fragmentary side elevation of the driving portion of the game with the mechanism behind the driving hand wheel and the partition wall shown in dotted lines;

FIG. 4 is a rear elevation, partly in section, of the driving portion, looking in the direction of the arrows 4—4 in FIG. 3;

FIG. 5 is a vertical section, taken along the line 5—5 in FIG. 3, with the pull cords connected to their respective spools at the start of a race, before winding thereon commences;

FIG. 6 is an enlarged front elevation, partly in section, of the starting gate, taken along the line 6—6 in FIG. 1;

FIG. 7 is a vertical section through the starting gate of FIG. 6, taken along the line 7—7 therein;

FIG. 8 is a cross-section on an enlarged scale taken along the line 8—8 in FIG. 1, showing one set of the pull cord guide members;

FIG. 9 is an enlarged side elevation, mainly in perspective, of a contestant piece; and FIG. 10 is a vertical section similar to the left-hand portion of FIG. 5, but showing one of the gear-rimmed spools wound up with its pull cord in one of the several random ways possible, at the end of a race.

Referring to the drawings in detail, FIGS. 1, 4 and 5 show a lane-length-compensating race game, generally designated 10, mounted in a bottomless box-shaped supporting structure 12 provided with side walls 14 and a top wall 16. The top wall 16 serves to support a J-shaped miniature race course 18 extending between a starting gate 20 and a finish line 22, which in turn is defined by a row of vertical guide holes 24 in the top wall 16. Outer and inner boundaries 26 and 28 respectively define the race course 18 and are roughly elongated oval shape. The race course 18 is shown for convenience as divided into six lanes 30, 32, 34, 36, 38 and 40 respectively (FIG. 6). The lanes 30 to 40 are defined by partitions 42 depending from an inverted U-shaped starting gate frame 44 consisting of uprights 46 joined to one another at their upper ends by an overhead member 48. The overhead member 48 is notched at equally-spaced intervals to receive the upstanding hook-shaped portions 50 (FIG. 7) by which the partitions 42 are held in laterally-spaced relationship. Each of the lanes 30 to 40 is occupied, at the start of a race, by a contestant piece 52 (FIGS. 1 and 9) which for illustrative purposes is shown as a race horse 54 ridden by a jockey 56 and supported on a base plate 58 of acute-angled triangular shape, to the apex 60 of which is connected a pull cord 62. Alternatively, the contestant pieces may simulate racing automobiles, dogs or the like. Thus, for the six contestant pieces 52 shown in FIG. 1 there are six pull cords 62 which are guided around the semi-circular end of the race course 18 by five guide units 64 (FIGS. 1 and 8).

Each guide unit 64 consists of an elongated supporting base 66 from which seven cord guide members 68 project upward through holes 70 in the top wall 16, to the underside of which the supporting base 66 is secured by fasteners 72. The pull cords 62 are trained around the guide members 68 and slide smoothly around them.

At the finish line 22, the cords 62 pass downward through the guide holes 24 (FIGS. 3 and 5) in the top wall 16 of the housing 12, thence through guide holes 74 in a lane-length-compensating sector gear 76 and finally through aligned guide holes 78 in a cross bar 80. The latter is secured to and extends between a side wall 14 and a parallel partition wall 82 having an angle portion or flange 84 secured by the fasteners 86 to the top wall 16 from which it depends. Each of the pull cords 62 terminates at and is secured at 87 to the hub 88 of a geared winding spool 90 having a smooth flange 92 and a toothed gear flange 94 at the opposite ends thereof. The winding spools 90 of which there is one for each pull cord 62, are loosely and rotatably mounted end-to-end or side-by-side along a non-rotatable shaft 96 (FIG. 5) extending between and supported by the side wall 14 and parallel partition wall 82, so that each spool 90 is rotatable, independently of the others. Spacing collars 98 and 99 extend respectively from the side wall 14 and partition wall 82 to the nearest spool 90.

The lane-length-compensating sector gear 76 is pivotally mounted on a pivot bolt 100 extending through and depending from the top wall 16 (FIG. 4) and spaced below it by a spacing washer 102. The sector gear 76 has an arcuate toothed periphery 104 (FIG. 2) centered at the axis of the pivot bolt 100 to rotate relatively thereto. At its rearward end the toothed periphery 104 terminates in a lock notch 106 extending further inward toward the pivot bolt 100 than the teeth 108.

Meshing with the teeth 108 of the sector gear 76 are the teeth 110 of a drive gear 112 (FIGS. 2, 3 and 4) keyed or otherwise drivingly secured to a drive shaft 114 journaled at its opposite ends in the side wall 14 and partition wall 82 respectively. Also keyed or otherwise drivingly secured to the drive shaft 114 is a hand wheel 116 carrying an operating knob 118 near its periphery. Also keyed or otherwise drivingly secured to the drive shaft 114 is an elongated half gear 120, the teeth 122 of which mesh with corresponding teeth 94 of the geared winding spools 90. As a result of this construction, when the hand wheel 116 is rotated in a clockwise direction (FIG. 3), the sector gear 76 and geared winding spools 90 rotate in counterclockwise directions. When the teeth 122 of the half gear 120 move out of mesh with the teeth 94 of the geared winding spools 90 as the flat side 124 of the gear 120 passes the spools 90, it interrupts their driving connection momentarily and leaves them free to be rotated by pulling backward upon the cords 62 so as to unwind them from their hubs 88 as explained more fully below in connection with the operation of the invention.

In order to automatically lock the sector gear 76 in its foremost position until the end of a race, the top wall 16 of the housing 12 is drilled vertically at 126 (FIGS. 3 and 4) to slidably receive a lock pin 128. To this lock pin 128 is secured a stop washer 130 for limiting the downward travel of the lock pin 128 to the thickness of the sector gear 76 at the lock notch 106.

In the operation of the invention, let it be assumed that the contestant pieces 52 have been placed in the lane spaces 30 to 40 between the partitions 48 in the starting gate 20 and that their respective pull cords 62 have been trained around the guide members 68 of the guide units 64 and through the holes 24, 74 and 78 (FIG. 5) and secured at 87 to the hubs 88 of their respective geared winding spools 90. (Let it be recalled that in FIG. 5 only one cord 62 is shown connected to a spool 90 and that it is shown as wound upon the spool at the finish of the race.) To start the race with the six contestant pieces 52, the operator then grasps the knob 118 of the hand wheel 116 and manually rotates the latter, together with its shaft 114 and drive half gear 120, in a clockwise direction. This action rotates the geared spools 90 in a counterclockwise direction, consequently winding up the pull cords 62 upon the hubs 88 of the spools 90 in a random manner, varying in a haphazard unpredictable pattern from spool to spool. One such winding of a cord 62 at the end of a race is shown in FIG. 10, but the actual distribution of the winding upon the hub 88 depends upon how the particular cord 62 happens to coil itself upon its particular hub 88.

Meanwhile, the drive gear 112 swings the lane-length-compensating sector gear 76 around its pivot bolt 100, causing the pull cord guide holes 74 therein to move different arcuate distances from the axis of the pivot bolt 100 in a counterclockwise direction, carrying with them their cords 62 in such a manner that the cord 62 in the hole 74 farthest from the pivot bolt 100 is pulled the greatest distance to the right (FIG. 2), whereas the cord 62 in the hole 74 nearest the pivot bolt 100 is pulled the least distance. This action compensates for the greater distance which the outside horse or other contestant piece 52 has to travel in its outside lane 40 from the starting gate 20 to the finish line 22, as compared with the inside piece 52 in its inside lane 30.

Meanwhile, the operator turns the hand wheel 116 continuously, even though the half gear teeth 122 become disengaged with the toothed gear flange 94 during each half revolution of the hand wheel 116. As a result, after a few turns of the crank 116, the lock pin 124 drops into the lock notch 106 in the sector gear 76 and locks it in position until the end of the race. Meanwhile, the pull cords 62 are pulled intermittently toward their respective spools 90. When, however, the leading horse or other leading contestant piece 52 arrives at the finish line 22, denoted by the holes 24, it becomes the winner and the race is over.

To run another race, the operator lifts the lock pin 124 from the lock notch 106 while he turns the hand crank 118 until the half gear 120 becomes disengaged with the spool gears 90 so that the flat surface 124 of the half gear 120 faces the gear spools 90, hence, the driving connection between the hand wheel 116 and the spools 90 is broken. The operator then pulls each of the horses or other contestant pieces 52 backward from the finish line 22 to the starting gate 20, causing the pull cords 62 to unwind from the hubs 88 of the gear spools 90. Meanwhile, the hand wheel 116 is rotated in a counterclockwise direction to swing the sector gear 76 in a clockwise direction back to its starting position shown in FIGS. 2 and 3. As a result of this action, the lane-length-compensating holes 74 and the cords 62 passing through them likewise move back to their starting positions beneath the guide holes 24, and another race is ready to be run.

I claim:

1. A lane-length-compensating race game comprising a race game supporting structure having an approximately J-shaped race course with multiple parallel lanes thereon and with starting and finish positions thereon disposed remote from one another and with a curved portion therebetween, a multiplicity of contestant pieces adapted to be moved along said lanes between said starting and finish positions, means at said starting position for holding said contestant pieces laterally apart from one another and within said lanes, a multiplicity of winding spools rotatably mounted side-by-side on said structure at a location beyond said finish position in spaced relationship therewith, a multiplicity of elongated flexible pull elements disposed in a substantially common plane along said lanes, each pull element having a leading end connected to one of said winding spools for winding thereon in response to rotation thereof, each pull element having a trailing end connected to a corresponding one of said contestant pieces, means for guiding said pull elements in said lanes around said curved portion of said race course, a lane-length-compensator pivotally mounted on said structure between said finish position and said winding spools for swinging in the plane of said pull elements toward and away from said finish position, said compensator having pull element guides thereon disposed in radially-spaced locations therealong, said pull elements passing through said guides, and driving mechanism for simultaneously rotating said winding spools and swinging said compensator relatively to said finish position.

2. A lane-length-compensating race game, according to claim 1, wherein there is provided means for drivingly disconnecting said winding spools and said compensator from said driving mechanism.

3. A lane-length-compensating race game, according to claim 1, wherein said mechanism includes gearing operatively connecting said compensator and said winding spools, and wherein said mechanism also includes a driving device rotatingly connected to said gearing.

4. A lane-length-compensating race game, according to claim 3, wherein said gearing includes an elongated drive gear having teeth disposed around only a part of the circumference thereof, and wherein said winding spools have driven gears thereon operatively connected to said drive gear.

5. A lane-length-compensating race game, according to claim 1, wherein said compensator includes a sector gear, and wherein said driving mechanism includes a driving gear meshing with said sector gear.

6. A lane-length-compensating race game, according to claim 5, wherein said driving mechanism also includes gearing simultaneously rotating said winding spools and said driving gear.

7. A lane-length-compensating race game, according to claim 5, wherein a lock member is slidably mounted in said structure with one end of said lock member slidably engaging the face of said sector gear, and wherein said sector gear has a recess therein lockingly receiving said lock member in response to the arrival of said sector gear at its rearmost position.

8. A lane-length-compensating race game, according to claim 1, wherein a shaft is mounted on said structure at said location beyond said finish position, and wherein said winding spools are loosely and rotatably mounted on said shaft.

9. A lane-length-compensating race game, according to claim 8, wherein each winding spool has a gear secured thereto in coaxial relationship therewith, and wherein said driving mechanism includes gearing simultaneously in mesh with said winding spool gears.

* * * * *